US009534458B2

(12) United States Patent
Duman et al.

(10) Patent No.: US 9,534,458 B2
(45) Date of Patent: Jan. 3, 2017

(54) HYDRAULIC CUSHION

(71) Applicant: Hydril USA Distribution LLC, Houston, TX (US)

(72) Inventors: Ahmet Duman, Houston, TX (US); Michael Denk, Houston, TX (US); Devon Daniel, Houston, TX (US)

(73) Assignee: Hydril USA Distribution LLC, Houston, TX (US)

( * ) Notice: Subject to any disclaimer, the term of this patent is extended or adjusted under 35 U.S.C. 154(b) by 537 days.

(21) Appl. No.: 14/020,568

(22) Filed: Sep. 6, 2013

(65) Prior Publication Data

US 2014/0262531 A1 Sep. 18, 2014

Related U.S. Application Data

(60) Provisional application No. 61/791,615, filed on Mar. 15, 2013.

(51) Int. Cl.
*E21B 21/00* (2006.01)
*E21B 21/10* (2006.01)
(Continued)

(52) U.S. Cl.
CPC ..... *E21B 21/001* (2013.01); *E21B 21/106* (2013.01); *F04B 7/02* (2013.01); *F04B 15/02* (2013.01);
(Continued)

(58) Field of Classification Search
CPC ..... E21B 21/001; E21B 21/106; E21B 34/04; E21B 34/08; E21B 34/10; F04B 7/02; F04B 15/02; F04B 43/073; F04B 53/1022
(Continued)

(56) References Cited

U.S. PATENT DOCUMENTS 2,703,055 A * 3/1955 Jan Veth ..... F04B 43/073 417/205
3,379,405 A * 4/1968 Natho ..... E21B 33/06 251/31
(Continued)

FOREIGN PATENT DOCUMENTS

| | | |
|---|---|---|
| EP | 1 082 515 A1 | 3/2001 |
| WO | 2011/051453 A2 | 5/2011 |
| WO | 2012/091706 A1 | 7/2012 |

OTHER PUBLICATIONS

International Search Report and Written Opinion issued in connection with corresponding PCT Application No. PCT/US2014/027929 dated Oct. 22, 2014.
(Continued)

*Primary Examiner* — Matthew R Buck
(74) *Attorney, Agent, or Firm* — Hogan Lovells US LLP

(57) ABSTRACT

Drilling mud is lifted subsea to a drilling vessel with a mud pump having an internal bladder. Applying pressurized water to one side of the bladder urges it against a quantity of the mud to impart a lifting force onto the mud. Mud flow to and from the pump is controlled by valves driven by actuators. The actuators include a piston in a cylinder, a stem that connects the piston to a valve member, and ports for supplying fluid to opposing ends of the piston for selectively reciprocating the piston. Cavities are strategically location in the cylinder for absorbing vibrational forces generated when the piston reaches an end of its stroke.

17 Claims, 5 Drawing Sheets

(51) Int. Cl.
*F04B 7/02* (2006.01)
*F04B 15/02* (2006.01)
*F04B 43/073* (2006.01)
*F04B 53/10* (2006.01)

(52) U.S. Cl.
CPC ..... *F04B 43/073* (2013.01); *F04B 53/1022* (2013.01)

(58) Field of Classification Search
USPC ..... 175/5
See application file for complete search history.

(56) References Cited

U.S. PATENT DOCUMENTS 3,624,802 A * 11/1971 Ripert ..... F16K 41/02 251/31
4,650,151 A * 3/1987 McIntyre ..... E21B 34/04 137/236.1
4,755,111 A * 7/1988 Cocchi ..... F04B 43/1136 417/394
5,273,405 A * 12/1993 Chalmers ..... F01L 25/08 417/397
6,102,673 A * 8/2000 Mott ..... E21B 21/001 137/596.17
6,325,159 B1 * 12/2001 Peterman ..... E21B 21/001 166/350
2004/0007392 A1 * 1/2004 Judge ..... E21B 21/001 175/206
2006/0201678 A1 9/2006 Judge et al.
2008/0105434 A1 5/2008 Orbell et al.
2009/0139769 A1 6/2009 Traylor

OTHER PUBLICATIONS

International Search Report and Written Opinion issued in connection with related PCT Application No. PCT/US2014/027742 on Jul. 24, 2014.
International Search Report and Written Opinion issued in connection with related PCT Application No. PCT/US2014/027928 on Jul. 24, 2014.
Ahmet Duman, et al., Sep. 6, 2013, U.S. Appl. No. 14/020,531.
Ahmet Duman, et al., Sep. 6, 2013, U.S. Appl. No. 14/020,546.
Ahmet Duman, et al., Sep. 6, 2013, U.S. Appl. No. 14/020,586.

* cited by examiner

HYDRAULIC CUSHION

CROSS REFERENCE TO RELATED APPLICATIONS

This application claims priority to and the benefit of U.S. Provisional Application Ser. No. 61/791,615, filed Mar. 15, 2013, the full disclosure of which is hereby incorporated by reference herein for all purposes.

BACKGROUND OF THE INVENTION

1. Field of Invention

The present disclosure relates in general to dampening the opening and closing of hydraulic actuators for mud lift pump valves by providing cavities for hydraulic fluid accumulation in the actuators.

2. Description of Prior Art

Subsea drilling systems typically employ a vessel at the sea surface, a riser connecting the vessel with a wellhead housing on the seafloor, and a drill string. A drill bit is attached on a lower end of the drill string, and used for excavating a borehole through the formation below the seafloor. The drill string is suspended subsea from the vessel into the riser, and is protected from seawater while inside of the riser. Past the lower end of the riser, the drill string inserts through the wellhead housing just above where it contacts the formation. Generally, a rotary table or top drive is provided on the vessel for rotating the string and bit. Drilling mud is usually pumped under pressure into the drill string, and is discharged from nozzles in the drill bit. The drilling mud, through its density and pressure, controls pressure in the well and cools the bit. The mud also removes formation cuttings from the well as it is circulated back to the vessel. Traditionally, the mud exiting the well is routed through an annulus between the drill string and riser. However, as well control depends at least in part on the column of fluid in the riser, the effects of corrective action in response to a well kick or other anomaly can be delayed.

Fluid lift systems have been deployed subsea for pressurizing the drilling mud exiting the wellbore. Piping systems outside of the riser carry the mud pressurized by the subsea lift systems. The lift systems include pumps disposed proximate the wellhead, which reduce the time for well control actions to take effect.

SUMMARY OF THE INVENTION

Disclosed herein is a system for lifting drilling mud from subsea to a drilling vessel that addresses vibratory forces generated by a valve actuator. In an example the system includes mud pumps selectively disposed subsea, a valve in a flow line that contains drilling mud from the wellbore, and an actuator coupled with the valve. The actuator is made up of an actuator body, a cylinder in the body, a piston in the cylinder, and a cavity in the body in unrestricted communication with the cylinder. In an embodiment, the cavity is strategically located in the actuator body so that when the piston reciprocates in the cylinder in response to application of fluid to a high pressure side of the piston, fluid on a low pressure side of the piston flows into the cavity. Optionally, the cavity is disposed proximate an end of the cylinder. Example cavities include a frustoconical chamber that projects axially away from an end of the cylinder and into the actuator body, an annular chamber that circumscribes the cylinder, and the like. The mud pump can include a housing with a bladder disposed inside to define a water space on one side that is in communication with a water supply line and a water discharge line, and a mud space on an opposite side that is in communication with a mud supply line and a mud discharge line, and wherein selectively providing pressurized water in the water supply line pressurizes mud in the mud space.

An alternative system for lifting drilling mud from a subsea wellbore includes a mud pump which is made of a housing, a water space in the housing, a mud space in the housing that is in pressure communication with the water space, a bladder mounted in the housing having a side in contact with the water space and an opposing side in contact with the mud space, and that defines a flow barrier between the water and mud space, a mud valve disposed in a line having drilling mud and that is in communication with the mud space, and a hydraulic actuator coupled with the mud valve. The actuator has an actuator body, a cylinder in the actuator body, a piston that reciprocates in the cylinder, and a cavity in the actuator body proximate an end of the cylinder, so that when the piston is at an end of a stroke, hydraulic fluid pools in the cavity to define a cushion that absorbs energy from a deceleration of the piston. The cavity can be an upper cavity that projects away from an end of the cylinder distal from a valve coupled to the hydraulic actuator. The cavity can alternatively be a lower cavity that is defined where an axial portion of the cylinder has an increased radius. Optionally, the system can have a first cavity that is strategically disposed to absorb energy when the piston is at the end of a stroke in a first direction, and a second cavity distal from the first cavity and strategically disposed to absorb energy when the piston is at the end of a stroke in a second direction. The mud valve can be a mud inlet valve that is disposed in the line between mud flowing from the wellbore and to the mud pump. The mud valve can also be a mud outlet valve that is disposed in the line between the mud pump and sea surface. The mud pump can further include a water inlet line having an entrance in selective communication with a source of pressurized water, and an exit in communication with the water space, and a water discharge line having an entrance in communication with the water space, and an exit in selective communication with a water effluent line.

An optional system for lifting drilling mud from a subsea wellbore includes a mud pump selectively disposed subsea that connects with a mud supply line that contains mud from the wellbore, and that connects to a discharge line having drilling mud discharged from the pump and that terminates above sea surface, a selectively openable and closeable mud inlet valve in the mud supply line, and an actuator. In this example the actuator has a body, a cylinder formed in the body, a piston reciprocatingly disposed in the cylinder, a stem connected between the piston and a valve member in the mud inlet valve, and a cavity in the body having an interface surface that borders a portion of an outer periphery of the cylinder. The cavity can project axially away from an end of the cylinder and the interface surface is substantially planar, or alternatively can project radially outward from an outer circumference of the cylinder and the interface surface is curved.

BRIEF DESCRIPTION OF DRAWINGS

Some of the features and benefits of the present invention having been stated, others will become apparent as the description proceeds when taken in conjunction with the accompanying drawings, in which.

Figure 1:
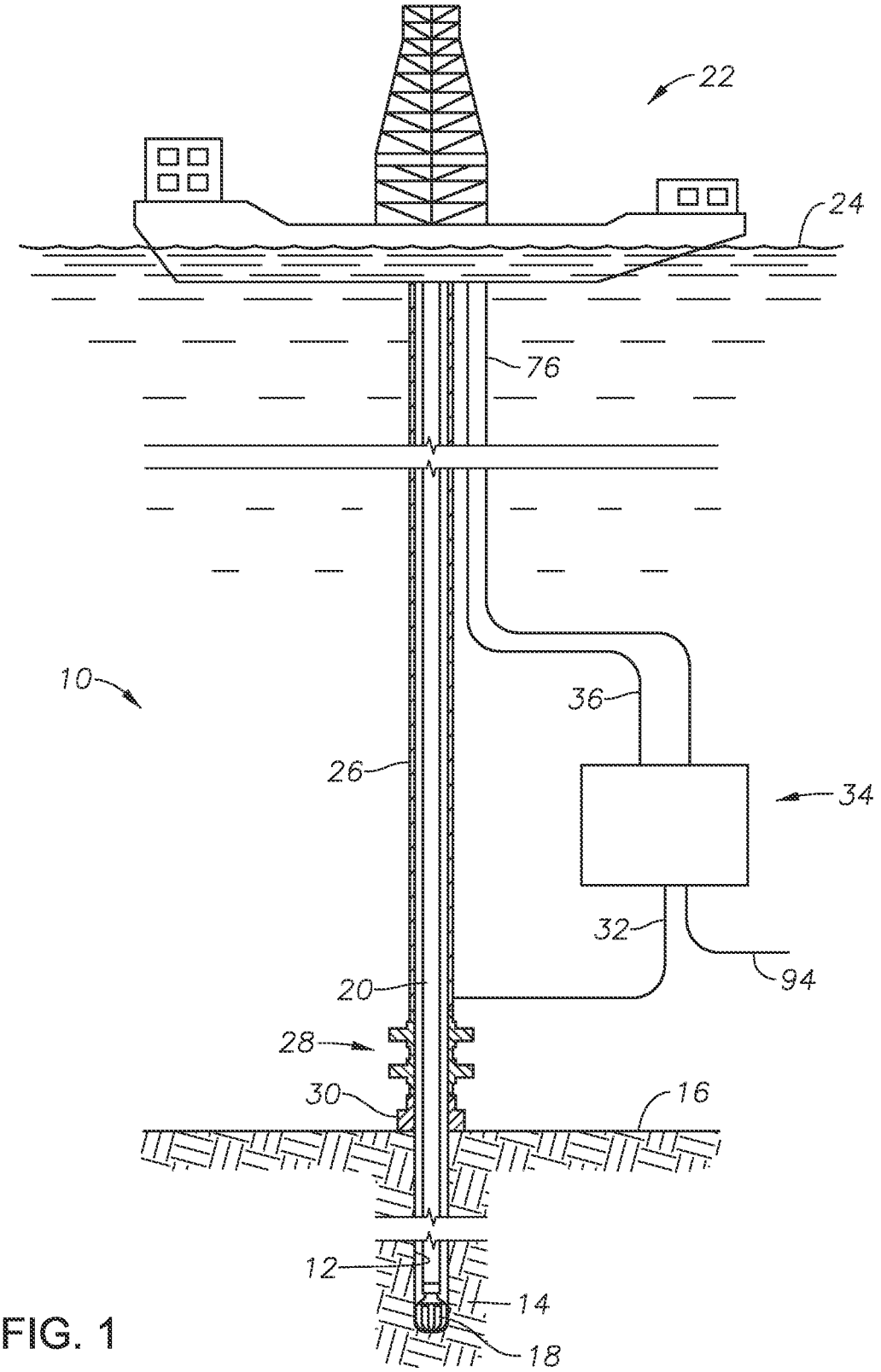
FIG. 1 is a side sectional view of an example of a subsea drilling system having a lift pump assembly and in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in FIG. 1 is a side partial sectional view of an example embodiment of a drilling system 10 for forming a wellbore 12 subsea. The wellbore 12 intersects a formation 14 that lies beneath the sea floor 16. The wellbore 12 is formed by a rotating bit 18 coupled on an end of a drill string 20 shown extending subsea from a vessel 22 floating on the sea surface 24. The drill string 20 is isolated from seawater by an annular riser 26; whose upper end connects to the vessel 22 and lower end attaches onto a blowout preventer (BOP) 28. The BOP 28 mounts onto a wellhead housing 30 that is set into the sea floor 16 over the wellbore 12. A mud return line 32 is shown having an end connected to the riser 26 above BOP 28, which routes drilling mud exiting the wellbore 12 to a lift pump assembly 34 schematically illustrated subsea. Within the lift pump assembly 34, drilling mud is pressurized for delivery back to the vessel 22 via mud return line 36.

Figure 2:
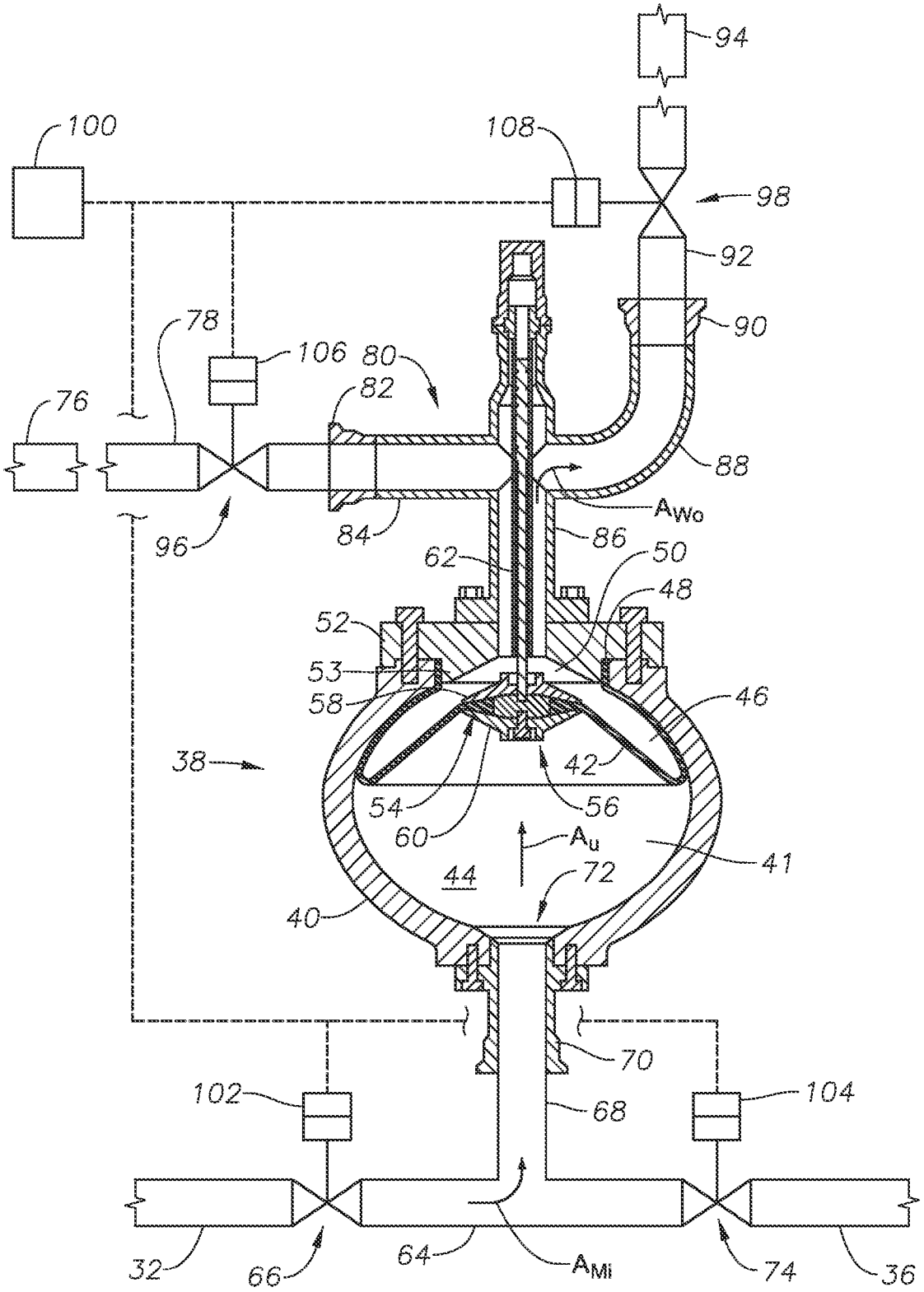
FIGS. 2 and 3 are partial side sectional views of an example of a subsea pump for use with the drilling system of FIG. 1 in different pumping modes and in accordance with the present invention.

FIG. 2 includes a side sectional view of an example of a pump 38 for use with lift pump assembly 34 (FIG. 1). Pump 38 includes a generally hollow and elliptically shaped pump housing 40. Other shapes for the housing 40 include circular and rectangular, to name a few. An embodiment of a flexible bladder 42 is shown within the housing 40; which partitions the space within the housing 40 to define a mud space 44 on one side of the bladder 42, and a water space 46 on an opposing side of bladder 42. As will be described in more detail below, bladder 42 provides a sealing barrier between mud space 44 and water space 46. In the example of FIG. 2, bladder 42 has a generally elliptical shape and an upper open space 48 formed through a side wall. Upper open space 48 is shown coaxially registered with an opening 50 formed through a side wall of pump housing 40. A disk-like cap 52 bolts onto opening 50, where cap 52 has an axially downward depending lip 53 that coaxially inserts within opening 50 and upper open space 48. A portion of the bladder 42 adjacent its upper open space 48 is wedged between lip 53 and opening 50 to form a sealing surface between bladder 42 and pump housing 40.

A lower open space 54 is formed on a lower end of bladder 42 distal from upper open space 48, which in the example of FIG. 2 is coaxial with upper open space 48. An elliptical bumper 56 is shown coaxially set in the lower open space 54. The bumper 56 includes upper and lower segments 58, 60 coupled together in a clam shell like arrangement, and that respectively seal against upper and lower radial surfaces on the lower open space 54. The combination of sealing engagement of cap 52 and bumper 56 with upper and lower open spaces 42, 54 of bladder 42, effectively define a flow barrier across the opposing surfaces of bladder 42. Further shown in the example of FIG. 2 is an axial rod 62 that attaches coaxially to upper segment 56 and extends axially away from lower segment 58 and through opening 50.

Still referring to FIG. 2, a mud line 64 is shown having an inlet end connected to mud return line 32, and an exit end connected with mud return line 36. A mud inlet valve 66 in mud line 64 provides selective fluid communication from mud return line 32 to a mud lead line 68 shown branching from mud line 64. Lead line 68 attaches to an annular connector 70, which in the illustrated example is bolted onto housing 40. Connector 70 mounts coaxially over an opening 72 shown formed through a sidewall of housing 40 and allows communication between mud space 44 and mud line 64 through lead line 68. A mud exit valve 74 is shown in mud line 64 and provides selective communication between mud line 64 and mud return line 36.

Water may be selectively delivered into water space 46 via a water supply line 76 shown depending from vessel 22 and connecting to lift pump assembly 34 (FIG. 1). Referring back to FIG. 2, a water inlet lead line 78 has an end coupled with water supply line 76 and an opposing end attached with a manifold assembly 80 that mounts onto cap 52. The embodiment of the manifold assembly 80 of FIG. 2 includes a connector 82, mounted onto a free end of a tubular manifold inlet 84, an annular body 86, and a tubular manifold outlet 88, where the inlet and outlet 84, 88 mount on opposing lateral sides of the body 86 and are in fluid communication with body 86. Connector 82 provides a connection point for an end of water inlet lead line 78 to manifold inlet 84 so that lead line 78 is in communication with body 76. A lower end of manifold body 86 couples onto cap 52; the annulus of the manifold body 86 is in fluid communication with water space 46 through a hole in the cap 52 that registers with opening 50. An outlet connector 90 is provided on an end of manifold outlet 88 distal from manifold body 86, which has an end opposite its connection to manifold outlet 88 that is attached to a water outlet lead line 92. On an end opposite from connector 90, water outlet lead line 92 attaches to a water discharge line 94; that as shown in FIG. 1, may optionally provide a flow path directly subsea.

A water inlet valve 96 shown in water inlet lead line 78 provides selective water communication from vessel 22 (FIG. 1) to water space 46 via water inlet lead line 78 and manifold assembly 80. A water outlet valve 98 shown in water outlet lead line 92 selectively provides communication between water space 46 and water discharge line 94 through manifold assembly 80 and water outlet lead line 92.

In one example of operation of pump 38 of FIG. 2 mud inlet valve 66 is in an open configuration, so that mud in mud return line 32 communicates into mud line 64 and mud lead line 68 as indicated by arrow $A_{Mi}$. Further in this example, mud exit valve 74 is in a closed position thereby diverting mud flow into connector 70, through opening 72, and into mud space 44. As illustrated by arrow $A_U$, bladder 42 is urged in a direction away from opening 72 by the influx of mud, thereby imparting a force against water within water space 46. In the example, water outlet valve 98 is in an open position, so that water forced from water space 46 by bladder 42 can flow through manifold body 86 and manifold outlet 88 as illustrated by arrow $A_{Wo}$. After exiting manifold outlet 88, water is routed through water outlet lead line 92 and into water discharge line 94.

Figure 3:
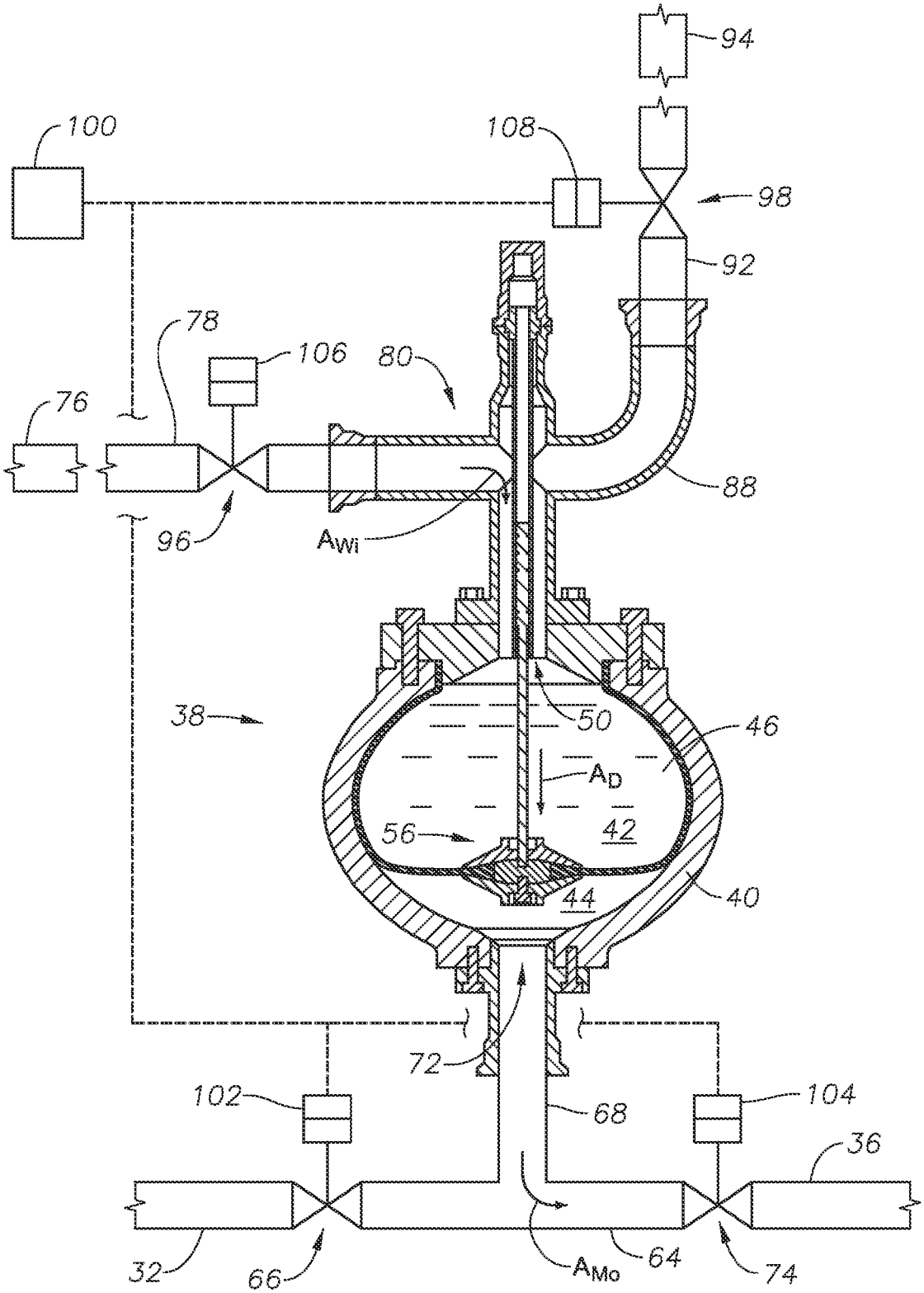

An example of pressurizing mud within mud space 44 is illustrated in FIG. 3, wherein valves 66, 98 are in a closed position and valves 96, 74 are in an open position. In this example, pressurized water from water supply line 76 is free to enter manifold assembly 80 where as illustrated by arrow $A_{Wi}$, the water is diverted through opening 50 and into water space 46. Introducing pressurized water into water space 46 urges bladder 42 in a direction shown by arrow $A_D$. Pressurized water in the water space 46 urges bladder 42 against the mud, which pressurizes mud in mud space 44 and directs it through opening 72. After exiting opening 72, the pressurized mud flows into lead 68, where it is diverted to mud return line 36 through open mud exit valve 74 as illustrated by arrow $A_{Mo}$. Thus, providing water at a designated pressure into water supply line 76 can sufficiently pressurize mud within mud return line 36 to force mud to flow back to vessel 22 (FIG. 1).

In the examples of FIGS. 2 and 3, included is a controller 100 shown in communication with actuators 102, 104, 106, 108 respectively coupled with the valves 66, 74, 78, 98 and that provide means for opening and closing valves 66, 74, 78, 98. In one example embodiment, controller 100 communicates commands to the actuators to selectively open and/or close valves 66, 74, 78, 98. In an embodiment, controller 100 includes an information handling system (IHS) that receives or contains instructions to selectively operate valves 66, 74, 78, 98.

Figure 4:
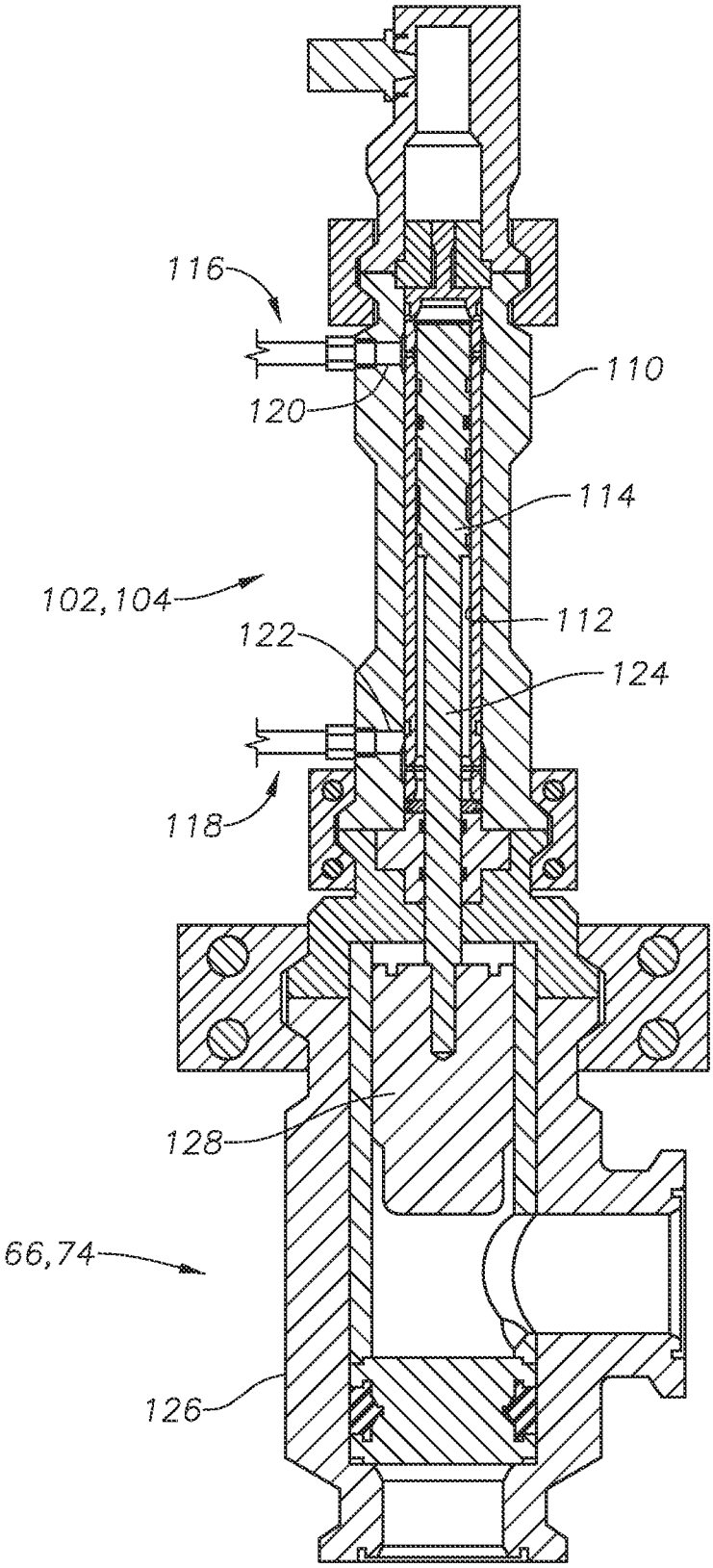
FIG. 4 is a side sectional view of a valve used with the pump of FIGS. 2 and 3 and in accordance with the present invention.

FIG. 4 is a side sectional view of an example of actuators 102, 104 used with mud inlet and exit valves 66, 74. Actuators 102, 104 include an elongate body 110 having a cylinder 112 generally coaxial within body 110. A piston 114 is set in the cylinder 112 and reciprocates therein for opening and closing valves 66, 74. Hydraulic lines 116, 118 connect respectively to ports 120, 122 shown formed laterally through a sidewall of the body 110 to the cylinder 112. Hydraulic fluid in hydraulic lines 116, 118 selectively flows into cylinder 112 via ports 120, 122 for urging the piston 114 axially within the cylinder 112. A valve stem 124 is shown having one end connected to an end of piston 114 proximate where actuator body 110 mounts onto a valve body 126. An end of stem 124 opposite its connection to piston 114 connects to a valve gate 128 that reciprocates within a cavity of the valve body 126 to selectively open and close valve 66, 74.

Figure 4A:
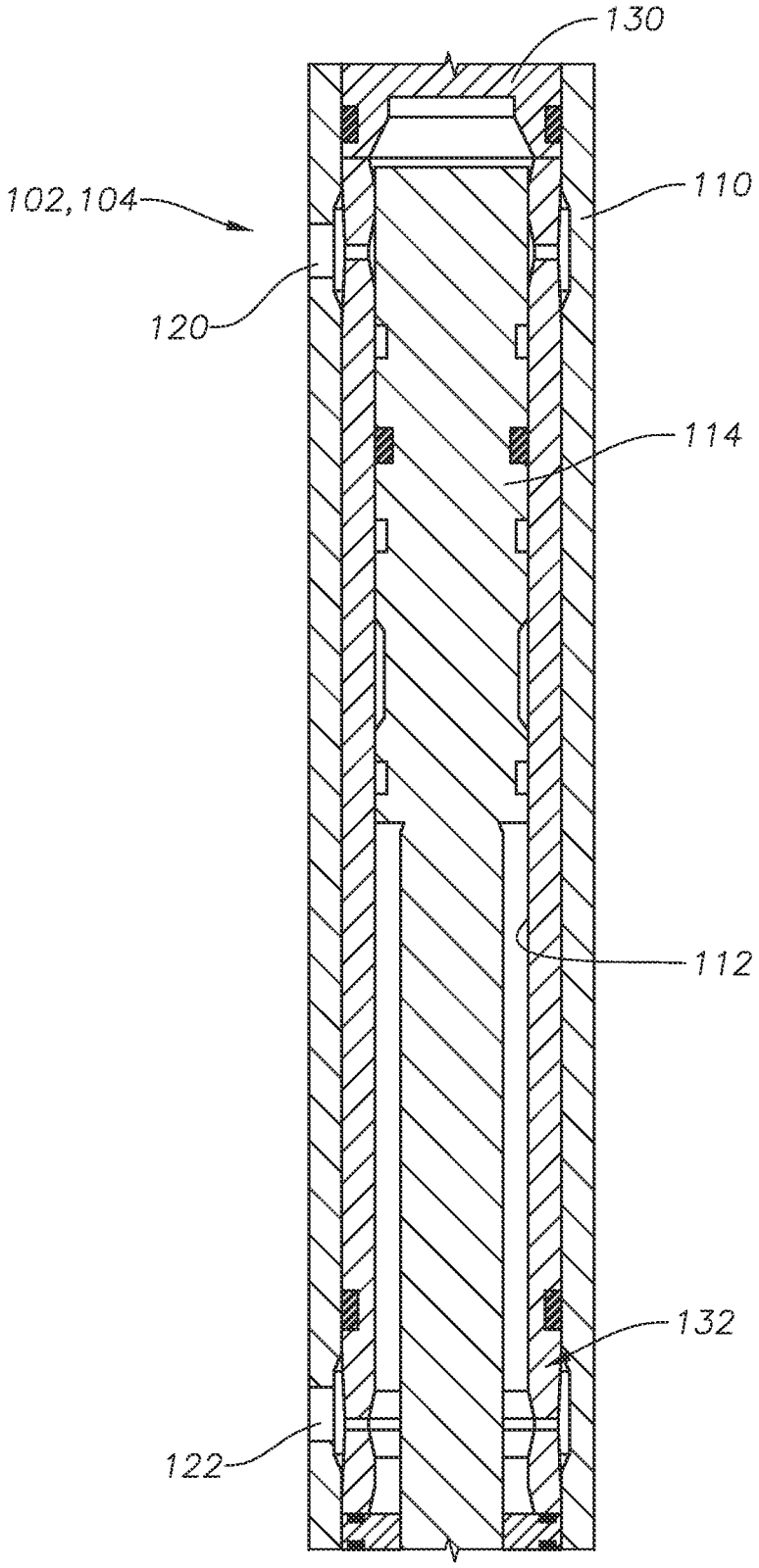
FIG. 4A is an enlarged side sectional view of a portion of the valve of FIG. 4 in accordance with the present invention.

FIG. 4A is a side sectional enlarged view of a portion of actuator 102, 104 of FIG. 4 and illustrates an upper cavity 130 formed into actuator body 110 distal from valve body 126. More specifically in the example of FIG. 4A, upper cavity 130 has a frusto-conical shape, is generally coaxial with cylinder 112, and projects axially away from an upper end of cylinder 112. Embodiments exist where the upper cavity 130 is formed in the sidewalls of cylinder 112, such as by a localized increase in a radius of the cylinder 112, or by grooves (not shown) that circumscribe the cylinder 112 or run axially to the cylinder 112. As such, when piston 114 reaches an end of its stroke to open valve 66, 74 and is proximate a closed end of cylinder 112, fluid flows into upper cavity 130 to prevent forces from being generated by trapping fluid in an enclosed space. The upper cavity 130 can also absorb and/or attenuate impulse forces generated by the piston 114 that might otherwise be transferred to the surrounding structure. The trapped fluid thereby reduces noise and vibration during operation of the actuator 102, 104.

Body 110 includes a lower cavity 132 is shown formed that is axial distal from cavity 130, and provides dampening when piston 114 is at the end of its down stroke and is closing valve 66, 74. Lower cavity 132 is defined where a radius of the cylinder 112 is increased along a discrete axial length of the body 110 proximate port 122. Similar to upper cavity 130, lower cavity 132 provides a space where a volume of hydraulic fluid can collect and absorb impulse forces that occur at the end of the stroke of piston 114. In the example of FIG. 4A, upper cavity 130 absorbs a volume of fluid to prevent impulse forces from being generated at an end of an upstroke of piston 114, and lower cavity 132 absorbs a volume of fluid to prevent impulse forces from being generated at an end of a downstroke of piston 114. In the example of FIG. 4A, the upper and lower cavities 130, 132 both have a surface that directly and wholly contacts an outer peripheral surface of cylinder 112. Thus fluid in the cylinder 112 can flow unrestricted into the cavities 130, 132.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A system for lifting drilling mud from a subsea wellbore comprising:

a mud pump selectively disposed subsea;

a valve in a flow line that contains drilling mud from the wellbore; and an actuator coupled with the valve comprising, an actuator body, a valve body coupled to the actuator body, a cylinder in the actuator body having a first end and a second end, a piston in the cylinder, the piston having a first end, a second end, and a stem extending from the second end of the piston into the valve body, first and second inlet ports in the actuator body to allow ingress of hydraulic fluid into the cylinder to stroke the piston axially within the cylinder between a maximum second end position and a maximum first end position, respectively, the first end of the piston being closer to the first end of the cylinder than the first inlet port while the piston is in the maximum first end position, and a first end cavity projecting beyond the first end of the cylinder and in unrestricted communication with the cylinder, the first end cavity being located beyond the first end of the piston while the piston is in the maximum first position.

2. The system of claim 1, further comprising:

an annular recess formed in an inner diameter of the actuator body that surrounds an outer diameter of the cylinder, the first inlet port extending through a side wall of the actuator body into the recess and from the recess through a side wall of the cylinder into an interior of the cylinder.

3. The system of claim 1, wherein the cylinder comprises a sleeve disposed within the actuator body.

4. The system of claim 1, wherein the first end cavity has a frustoconical side wall that projects axially away from the first end of the cylinder in a first direction and a closed end at a first end of the frustoconical side wall.

5. The system of claim 1, further comprising a second end annular recess between an outer diameter of the cylinder and an inner diameter of the actuator body, the second inlet port extending through actuator body into the recess and from the recess through a side wall of the cylinder into an interior of the cylinder.

6. The system of claim 1, wherein the mud pump comprises a housing with a bladder disposed inside to define a water space on one side that is in communication with a water supply line and a water discharge line, and a mud space on an opposite side that is in communication with a mud supply line and a mud discharge line, and wherein selectively providing pressurized water in the water supply line pressurizes mud in the mud space.

7. A system for lifting drilling mud from a subsea wellbore comprising:

a mud pump comprising, a housing;

a water space in the housing;

a mud space in the housing that is in pressure communication with the water space;

a bladder mounted in the housing having a side in contact with the water space and an opposing side in contact with the mud space, and that defines a flow barrier between the water and mud space;

a mud valve disposed in a line having drilling mud and that is in communication with the mud space; and a hydraulic actuator coupled with the mud valve, having an actuator body, a cylinder mounted within the actuator body, a piston that reciprocates in the cylinder, up stroke and down stroke inlet ports that extend through a side wall of the actuator body and through a side wall of the cylinder to allow ingress of hydraulic fluid into the cylinder to urge the piston axially within the cylinder between a maximum up stroke position and a maximum down stroke position, and up stroke and down stroke cavities in the actuator body proximate up stroke and down stroke ends of the cylinder, respectively so that when the piston is at the maximum up stroke and maximum down stroke positions, hydraulic fluid pools in the up stroke and down stroke cavities, respectively to define a cushion that absorbs energy from a deceleration of the piston; wherein each of the up stroke and the down stroke cavities comprises an annular recess located between an inner diameter of the actuator body and an outer diameter of the cylinder, and each of the up stroke and down stroke inlet ports extends into one of the recesses.

8. The system of claim 7, wherein the up stroke cavity further comprises an upper chamber that projects upward from the up stroke end of the cylinder, the upper chamber having a closed upper end spaced above the piston while the piston is in the maximum up stroke position.

9. The system of claim 8, wherein the down stroke inlet port extends through the cylinder at a point below an upper end of the piston while the piston is in the maximum up stroke position.

10. The system of claim 8, wherein the upper chamber has a frustoconical side wall.

11. The system of claim 7, wherein the mud valve comprises a mud inlet valve that is disposed in the line between mud flowing from the wellbore and to the mud pump.

12. The system of claim 7, wherein the mud valve comprises a mud outlet valve that is disposed in the line between the mud pump and sea surface.

13. The system of claim 7, wherein the mud pump further comprises, a water inlet line having an entrance in selective communication with a source of pressurized water, and an exit in communication with the water space; and a water discharge line having an entrance in communication with the water space, and an exit in selective communication with a water effluent line.

14. The system of claim 7, further comprising an annular seal ring located between the outer diameter of the cylinder and the inner diameter of the actuator body at a point between the up stroke and the down stroke cavities.

15. A system for lifting drilling mud from a subsea wellbore comprising:

a mud pump selectively disposed subsea that connects with a mud supply line that contains mud from the wellbore, and that connects to a discharge line having drilling mud discharged from the pump and that terminates above sea surface;

a selectively openable and closeable mud inlet valve in the mud supply line; and an actuator comprising, a body, a cylinder mounted in the body, the cylinder having an axis, a first end and a second end, a piston reciprocatingly disposed in the cylinder, the piston having a first end and a second end, a first end inlet port and a second end inlet port extending through a side wall of the body and through a side wall of the cylinder to allow ingress of hydraulic fluid into the cylinder to stroke the piston axially within the cylinder between a maximum first end position and a maximum second end position, a stem connected between the piston and a valve member in the mud inlet valve, and a first end chamber at the first end of the cylinder and extending axially from the first end of the piston while the piston is in the maximum first end position, an annular first end recess between an outer diameter of the cylinder and an inner diameter of the body that is intersected by the first end inlet port;

an annular second end recess between the outer diameter of the cylinder and the inner diameter of the body that is intersected by the second end inlet port; and an annular seal ring between the outer diameter of the cylinder and the inner diameter of the body at a point axially between the first end recess and the second end recess.

16. The system of claim 15, wherein the end of the piston moves axially past the first end inlet port while being stroked from the maximum second end position to the maximum first end position.

17. The system of claim 15, wherein the first end chamber has a frusto-conical side wall extending in a first direction past the first end of the cylinder.

* * * * *